United States Patent [19]

Mainiero et al.

[11] Patent Number: 4,818,972

[45] **Date of Patent: * Apr. 4, 1989**

[54] REINFORCED BARBED TAPE INCLUDING ELECTRICAL SENSOR

[75] Inventors: Michael R. Mainiero, Sandy Hook, Conn.; Anthony R. Zagami, Carmel, N.Y.

[73] Assignee: MRM Security Systems, Inc., Waterbury, Conn.

[ * ] Notice: The portion of the term of this patent subsequent to Jan. 2, 2005 has been disclaimed.

[21] Appl. No.: 125,471

[22] Filed: Nov. 25, 1987

Related U.S. Application Data

[63] Continuation-in-part of Ser. No. 927,833, Nov. 6, 1986, Pat. No. 4,718,641.

[51] Int. Cl.[4] ..... G08B 13/12

[52] U.S. Cl. ..... 340/566; 29/7.1; 140/66; 256/8; 340/541; 340/550

[58] Field of Search ..... 340/566, 550, 541; 256/8; 140/58, 66; 29/7.1

[56] References Cited

U.S. PATENT DOCUMENTS

| | | | |
|---|---|---|---|
| Re. 30,814 | 12/1981 | Mainiero | 72/294 |
| 186,922 | 2/1877 | Brinkerhoff | 256/8 |
| 386,742 | 7/1888 | Grellner | 256/8 |
| 2,908,484 | 10/1959 | Uhl | 256/8 |
| 3,010,701 | 11/1961 | Klemm | 256/8 |
| 3,463,455 | 8/1969 | Meckel | 256/8 |
| 3,763,482 | 10/1973 | Burney et al. | 340/566 |
| 3,947,835 | 3/1976 | Laymon | 340/566 |
| 4,028,925 | 6/1977 | Mainiero | 72/294 |
| 4,040,603 | 8/1977 | Mainiero | 256/8 |
| 4,503,423 | 3/1985 | Mainiero et al. | 340/552 |
| 4,509,726 | 4/1985 | Boggs et al. | 256/8 |
| 4,680,573 | 7/1987 | Ciordinik et al. | 340/550 |
| 4,718,641 | 1/1988 | Mainiero | 140/58 |

OTHER PUBLICATIONS

"Intrusion Detection Systems", by Robert L. Barnard—1981—pp. 71–74.

*Primary Examiner*—Glen R. Swann, III

*Attorney, Agent, or Firm*—Anthony J. Casella; Gerald E. Hespos

[57] ABSTRACT

A helical barbed tape includes barbs with enhanced rigidity, as well as an electrical sensor wire extending along the length of the helical barbed tape so as to be capable of use in an electronic intrusion detection system to mechanically detect disturbances induced on the barbed tape or its supporting structure.

13 Claims, 5 Drawing Sheets

REINFORCED BARBED TAPE INCLUDING ELECTRICAL SENSOR

CROSS REFERENCE TO RELATED APPLICATION

The subject application is a continuation-in-part of U.S. application Ser. No. 927,833 filed Nov. 6, 1986, by Michael M. Maniero, entitled "BARBED TAPE WITH REINFORCED BARBS", now U.S. Pat. No. 4,718,641, issued Jan. 12, 1988, and assigned to the assignee of the subject application.

BACKGROUND OF THE INVENTION

Helical barbed tape is used to create an elongated antipersonnel barrier. The helical barbed tape is defined by an elongated generally flat central support having clusters of barbs at spaced apart locations. Each cluster of barbs typically will comprise a first pair of barbs extending from a root on one side of the tape and a second pair of barbs extending from a root on the opposite side of the tape. Each barb is a generally elongated planar structure having two generally opposed edges converging toward one another and meeting at a very sharp point. The barbs in each pair lie in a common plane, but extend in generally opposite directions relative to one another. Furthermore, each pair of barbs is offset relative to the plane of the central supporting portion of the tape such that one barb in each pair extends angularly away from one surface of the central support while the other barb in that pair extends angularly away from the opposite surface of the central support. To achieve optimum effectiveness, the first and second pairs of barbs are offset in opposite angular directions. Thus, when the tape is viewed from its side, each cluster of barbs effectively defines an X.

The above described barbed tape is formed into a helical configuration such that the plane of the tape is aligned generally perpendicular to the axis of the helix. Thus, the points of the barbs extend in generally tangential directions relative to the helix, while the roots to which the pairs of barbs are joined extend in generally radially outward or radially inward directions relative to the helix. One preferred method for forming the above described helical barbed tape is described in U.S. patent application Ser. No. 876,715 which was filed on June 20, 1986 by John W. Mainiero, and which is entitled "BARBED TAPE AND APPARATUS AND PROCESS FOR MAKING SAME." Another method for forming the above described helical barbed tape is shown in U.S. Pat. No. 4,028,925 which issued to Michael R. Mainiero on June 14, 1977.

The helical barbed tape described above can be axially collapsed for shipment and storage such that each coil of the helix directly abuts the adjacent coil. However, the helical barbed tape is stretched out a preselected amount during deployment.

The above described helical barbed tape has a broad range of both private and governmental applications, all of which relate to security. In the typical private application, the helical barbed tape is mounted to the top of a fence or wall to prevent the fence or wall from being scaled by an intruder. A particularly prevalent private application consists of a single strand of the helical barbed tape mounted to the top of a chain link fence. The governmental applications can be considerably more complex depending upon the particular needs. For example, in military applications, one or more strands of the helical barbed tape will be stretched along the ground to define an antipersonnel barrier. In some such applications, it may be desirable to rapidly deploy the helical barbed tape to meet a particular exigency. At prisons and certain high security permanent military installations, several coils of the helical barbed tape may be employed with fences. In these instances, a plurality of coils of the barbed tape may be secured adjacent the base of the fence while one or more coils may be secured at the midpoint or top of the fence. In some of these instances, each coil will effectively define a double helix comprising an external helix generated in a first direction and smaller concentrically disposed internal helix generated in the opposite direction.

The helical barbed tapes are deployed such that a person attempting to pass therethrough will contact at least a portion of the helix. This initial contact often will be with one or more of the closely spaced barbs on the tape, which are formed with sufficient sharpness to inflict a severe wound. This initial contact with the tape will also cause wavelike movements elsewhere on the helical tape causing other barbed clusters to be urged into contact with the intruder. Thus, even if the initial contact with the helical barbed tape is at a location spaced from a barbed cluster, this initial harmless contact is virtually certain to urge other barbed clusters into the intruder.

Although the helical barbed tapes have proved to be much more effective than the older barbed wire concertina, there have been several problems. For example, it has been necessary to form the barbed tape from a material having a thickness sufficient to insure that each barb will be rigid enough to slash into an intruder and to maintain its shape during normal pre-installation handling. To insure the necessary barb strength, the tapes typically have been formed from a stainless steel 0.025 inches thick. The formation of the helical barbed tape from significantly thinner steel would result in barbs that bend in response to the forces exerted by or on the intruder or in response to forces normally encountered during handling, shipment or storage prior to installation. In the typical application, the helical barbed tape is formed from an austenitic stainless steel at least the central portions of which may be hardened to Rockwell 30 N 55. Although this material is expensive, the stainless steel is required to insure that the product will endure when exposed to the elements, and the 30 N 55 hardness of the central supporting portion contributes to the spring characteristics of the coil. The cost of the product is directly proportional to the thickness of the tape. Thus, it would be desirable to provide a tape that is thinner and therefore less costly. However, as explained above, the barbs of the thinner tape would bend too easily, thereby yielding an ineffective product.

The thickness of the steel also directly affects the weight of the helical barbed tape. Heavier products create various storage problems and substantially increase shipping costs. The heavy products also make rapid military deployments difficult. Furthermore, the heavy helical barbed tapes often require additional reinforcement to the fences upon which the coils are mounted.

In addition to these problems of cost and weight, the sharpness of the barb varies inversely to the thickness of the tape. Thus, the rigidity of a thick barb is achieved at the expense of sharpness.

Another aspect of the subject invention is an improved helical barbed tape having barbs with enhanced rigidity, and having electrical sensor means so as to be capable of use in an electronic intrusion detection system to mechanically detect disturbances induced on the barbed tape or its supporting structures, such a fence, wall, post, etc. Heretofore, it has been known to employ a standard chain link or barbed wire fence in combination with a linear length of coaxial cable transducer extending along the length of the fence and capable of producing an alarm when an intrusion or compromise of the fence is attempted. As an example, reference is made to U.S. Pat. No. 3,763,482 entitled "COAXIAL FENCE TRANSDUCER" which issued on Oct. 2, 1973 to Burney et al. In U.S. Pat. No. 3,763,482, a coaxial cable with a dielectric filler comprising a radially polarized electret develops and transmits a signal along the cable in response to deformation of the cable at any point along the length. Such a coaxial cable, when clamped to a chain link, barbed fence or similar fences in a generally straight disposition, generates an electrical signal in response to attempts of intruders to climb or cut the fence and transmits that signal to remote alarm equipment. Standard coaxial cable is modified to form such a transducer by heating the entire cable, applying a dc potential across the ends of the outer and inner conductors, while the dielectric filler is heat-softened, cooling the cable while maintaining the electrical stress on it, and finally removing the bias voltage. Signal amplification and processing electronics, which are connected to the cable, detect intrusions and discriminate against false alarm signals. As shown and described in U.S. Pat. No. 3,763,482, the coaxial cable is secured along the length of the fence by clamping rings. Other forms of known coaxial cables are capable of operating in a similar manner are generally known as piezoelectric transducers and geophone transducers.

Another prior art system is marketed under the trademark "PERISTOP" wire by Bigotec AG of Aaron, Switzerland, and comprises a galvanized hollow steel wire containing an insulated copper conductor, and is installed inside a conventional barbed tape concertina. The resulting PERISTOP barbed tape concertina is designed to respond only to the destruction or cutting through of a wire loop. The response is achieved through the electronic monitoring of interruptions or short circuits in the system.

In view of the above, it is an object of the subject invention to provide a helical barbed tape having barbs with improved rigidity.

It is another object of the subject invention to provide a helical barbed tape having barbs with improved sharpness.

It is an additional object of the subject invention to provide a helical barbed tape that can be formed from a thinner lighter tape while still maintaining sufficient rigidity of the barb.

It is a further object of the subject invention to provide a composite helical barbed tape having barbs with improved rigidity, and having an electrical vibration sensitive cable extending along the length thereof, with the barbed tape being disposed about said electrical cable.

SUMMARY OF THE INVENTION

The subject invention is directed to a helical barbed tape which may be formed from a unitary strip of metallic material having a thickness between 0.015–0.030 inches. The helical barbed tape comprises an elongated central supporting portion and a plurality of barb clusters spaced along the elongated central supporting portion. Each barb cluster may include first and second generally planar pairs of barbs disposed respectively on opposite sides of the central supporting portion, with each pair of barbs being joined to the central supporting portion by a root. The barbs in each pair may point in generally opposite directions from one another and may be aligned generally parallel to the elongated central supporting portion of the helical barbed tape. The barbs may be offset relative to a plane defined by the central supporting portion. Additionally, a first pair of barbs in each cluster may be offset in a direction opposite the offset of the second pair of barbs in that cluster.

The barbed tape is formed into a helical configuration such that the plane defined by the central supporting portion of the tape is generally perpendicular to the axis of the helix. Thus, the helical barbed tape can either be collapsed or expanded in the direction of the axis about which the helix is defined.

The barbs of the helical barbed tape are reinforced to provide increased rigidity for any given thickness of the tape. The probability of a barb bending when contacted is substantially less for more rigid barbs. Thus, the reinforced barbs will more positively perform their intended function of stopping an intruder. Additionally, the reinforced barbs enable a predetermined degree of barb rigidity to be achieved with a thinner barbed tape material that is lighter in weight, less expensive, easier to store and ship and easier to deploy rapidly.

The reinforcements may be unitary with the tape, and may be angularly aligned to portions of the associated barb adjacent thereto. Additionally, the reinforcements may be configured to be formed by the series of dies which also blank the barbs into the tape and/or offset the barbs from the plane of the tape.

In one embodiment, the reinforcement is provided by a reinforcing flange formed in an edge of each barb. The flange may extend along the edge of the barb most distant from the central supporting portion of the helical barbed tape. Additionally, the reinforcing flange may extend continuously between the points of the two barbs in each pair of barbs. The reinforcing flange may be formed by a fold in the barb such that the flange extends angularly from a plane defined by the remainder of the barb. The reinforcing flange may be disposed at an angle of between 30° and 90° to the plane defined by the remainder of the barb. The angular alignment of the reinforcing flange to the remainder of the barb preferably will be greater for barbs formed from thinner stock material. As will be explained further below, the presence of the flange will not affect the penetrating ability of the barb, and in fact will provide an additional cutting surface while assuring a sharp point.

An alternate or additional reinforcement may be defined by an embossment in each barb. The embossment may be spaced from the edges of the barb and extend from the plane defined by the edges of the barb. In one embodiment, each barb would be provided with a separate embossment the perimeter of which will generally follow, but be spaced from, the edges defining the point of the barb. Thus, each embossment may be of generally teardrop configuration. In another embodiment, the embossment may extend continuously between the two barbs in each pair, and may further extend at least partly into the root from which the barbs extend. In this embodiment, the embossment will reinforce both the barbs and the root to which they are joined.

In a further embodiment, the central supporting portion of the reinforced barbed tape is disposed about a vibration-sensitive electrical cable. More particularly, after the reinforced barbed tape is formed, it is roll formed about an elongated, vibration-sensitive electrical cable. When properly installed, the composite structure of the barbed tape and the vibration-sensitive electrical cable provides an improved physical barrier as well as an electrical alarm system which provides maximum security.

DETAILED DESCRIPTION OF THE PREFERRED EMBODIMENT

Figure 1:
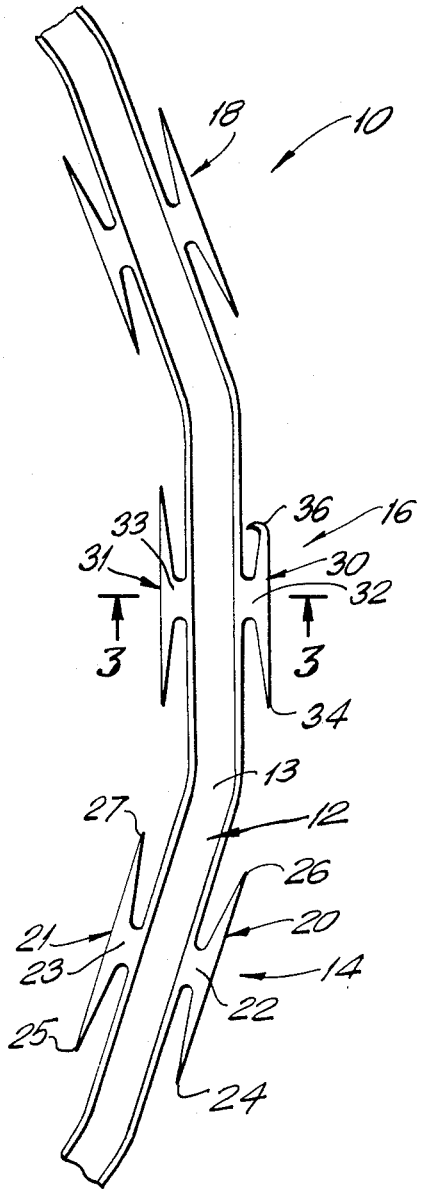
(PRIOR ART) FIG.1
FIG. 1 is a top plan view of a section of the prior art helical barbed tape.
Figure 2:
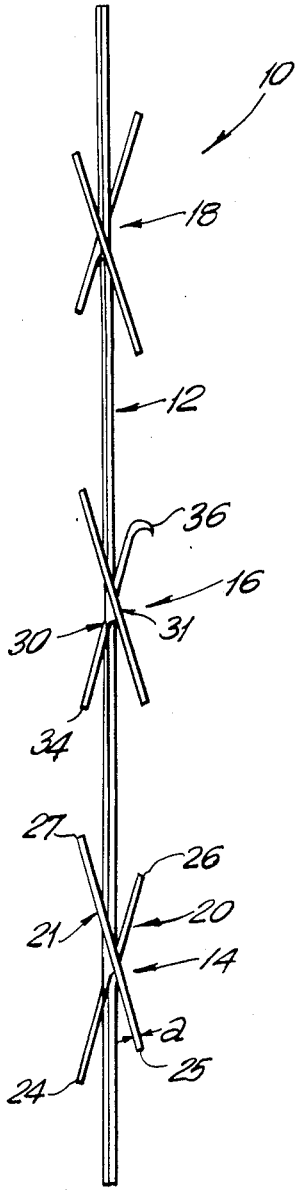
(PRIOR ART) FIG.2
FIG. 2 is a side elevational view of a section of a prior art helical barbed tape shown in FIG. 1.
Figure 3:
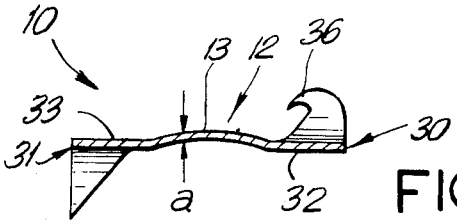
FIG.3 (PRIOR ART)
FIG. 3 is a cross-sectional view taken along line 3—3 in FIG. 1.
Figure 4:
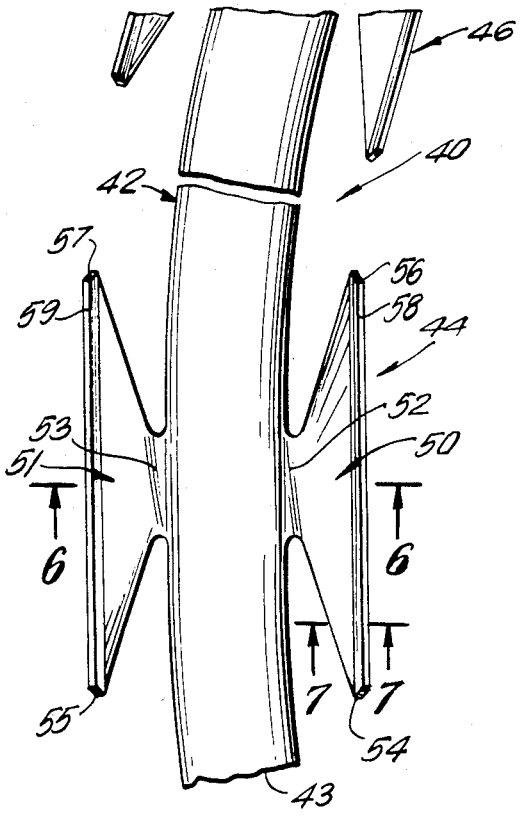
FIG. 4 is a top plan view of a section of helical barbed tape formed in accordance with the subject invention.
Figure 5:
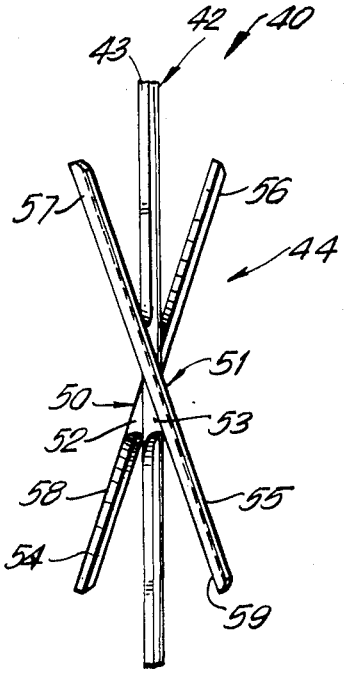
FIG. 5 is a side elevational view of the barbed tape shown in FIG. 4.

A portion of a typical prior art helical barbed tape is illustrated in FIGS. 1–3 and is identified generally by the numeral 10. The prior art helical barbed tape 10 defines a generally polygonal coil, a portion of which is shown most clearly in FIG. 1. The prior art helical barbed tape 10 comprises a central supporting portion 12 and a plurality of substantially identical barb clusters 14, 16 and 18 disposed at equally spaced locations along the central supporting portion 12. The central supporting portion 12 includes a longitudinally extending arcuate cavity 13 which is provided to enhance both the strength and spring characteristics of the prior art helical barbed tape 10. Barb cluster 14 comprises first and second pairs of barbs 20 and 21 which are joined to the central supporting portion by first and second roots 22 and 23 respectively. The first pair of barbs 20 comprises barbs 24 and 26 which extend in opposite directions from one another and generally parallel to the central supporting portion 12. Similarly, the second pair of barbs 21 comprises barbs 25 and 27 which extend in generally opposite directions and generally parallel to the central supporting portion 12. As shown more clearly in FIG. 2, the barbs 24 and 26 comprising the first pair of barbs 20 lie in a common plane which is angularly offset from the plane defined by central supporting portion 12. Similarly, the barbs 25 and 27 which comprise the second pair of barbs 21 also lie in a common plane which is angularly aligned to both the central supporting portion 12 and to the plane defined by the first pair of barbs 20. This angular alignment of the first and second pairs of barbs 20 and 21 is intended to enhance the ability of the barb cluster 14 to snare an intruder attempting to pass through the prior art helical barbed tape 10.

As shown most clearly in FIGS. 2 and 3, the prior art helical barbed tape 10 is formed from an initially flat stainless steel tape having a thickness indicated by dimension "a." For most governmental and private applications, the thickness "a" is selected to equal approximately 0.025 inches. As noted above, it would be extremely desirable to form the helical barbed tape 10 from a material having a thickness "a" less than 0.025 inches to achieve savings in raw material costs, to achieve sharper barbs and to obtain various shipping and storage efficiencies.

The goal of reducing the thickness "a" generally could not be achieved because of the tendency of the barbs on the prior art helical barbed tape 10 to bend. This tendency of the barbs on the prior art helical barbed tape 10 to bend existed at a thickness "a" of 0.025 inches and became substantially more likely at thicknesses "a" less than 0.025 inches. This problem is illustrated on the barb cluster 16 of the prior art helical barbed tape 10, as shown in FIGS. 1–3. Specifically, the barb cluster 10 comprises first and second pairs of barbs 30 and 31 which are joined to the central supporting portion 12 by roots 32 and 33 respectively. The first pair of barbs 30 comprises first and second barbs 34 and 36. As illustrated in FIGS. 1 and 2, the first barb 34 defines a substantially planar configuration similar to the configuration of barb 24 on barb cluster 14. However, the second barb 36 is bent out of its initial plane and back toward the root 32. This bent configuration of barb 36 could have been caused by any of several post-manufacturing handling steps which occurred prior to or during installation. As a result, the barb 36 would be rendered substantially ineffective. This bent configuration also could have been caused by an intruder who made an initial contact with the barb 36 and caused the barb 36 to bend into the configuration shown in FIGS. 1–3 without inflicting the intended injury upon the intruder.

The helical barbed tape of the subject invention is illustrated in FIGS. 4–7 and is identified generally by the numeral 40. The helical barbed tape 40 is a unitary structure which includes a central supporting portion 42 having a longitudinally extending arcuate cavity 43. The helical barbed tape 40 includes a plurality of barb clusters 44, 46 disposed at spaced apart locations along the central supporting portion 42. The barb cluster 44 includes first and second pairs of barbs 50 and 51 which are disposed on opposite sides of the central supporting portion 42 and are connected thereto by first and second roots 52 and 53 respectively. The first pair of barbs 50 comprises barbs 54 and 56 which extend in opposite directions and generally parallel to the central supporting portion 42. Similarly, the second pair of barbs 51 comprises barbs 55 and 57 which extend in opposite directions relative to one another and generally parallel to the direction of the central supporting portion 42. As shown most clearly in FIG. 5, the first and second pairs of barbs 50 and 51 are angularly offset relative to the plane defined by the central supporting portion 42. More particularly, the first pair of barbs 50 generally defines a plane angularly offset in a first direction relative to the plane of the central supporting portion 42, while the second pair of barbs generally defines a plane which is angularly offset in the opposite direction relative to the central supporting portion 42.

The first pair of barbs 50 is characterized by a reinforcing flange 58 unitary therewith and extending continuously along the edge of the first pair of barbs 50 most distant from the central supporting portion 42. More particularly, the reinforcing flange 58 extends continuously from the tip of barb 54 to the tip of barb 56. Similarly, the second pair of barbs 51 includes a reinforcing flange 59 unitary therewith and extending continuously along the edge of the second pair of barbs 51 most distant from the central supporting portion 42. The reinforcing flange 59 extends substantially continuously from the tip of barb 55 to the tip of barb 57.

Figure 6:
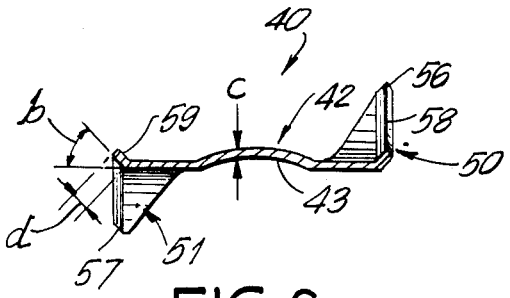
FIG. 6 is a cross-sectional view taken along line 6—6 in FIG. 4.
Figure 7:
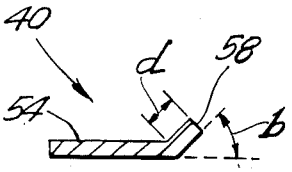
FIG. 7 is a cross-sectional view taken along line 7—7 in FIG. 4.

As shown most clearly in FIGS. 6 and 7, the reinforcing flanges 58 and 59 are angularly aligned to the plane of the remainder of the respective first and second pairs of barbs 50 and 51 by an angle "b." The angle "b" is between 30° and 90°, and in most instances is between approximately 45° and 60° for embodiments where the barbed tape 40 has a thickness "c" between approximately 0.018 inches and 0.025 inches. For embodiments where the barbed tape 40 has a thickness "c" less than 0.018 inches, the angle "b" may be between approximately 45° and 90°, with the greater angular alignments providing more rigidity. The width of the reinforcing flange 58, 59 is indicated by dimension "d" in FIGS. 6 and 7 and preferably is equal to or greater than the thickness "c" of the material from which the barbed tape 40 is formed.

The reinforcing flanges 58 and 59 substantially enhance the strength of the barbs 54–57 and prevent bending of the barbs during storage, shipment, installation and actual use. As a result, the resulting barbed tape 40 is significantly more effective and achieves a significantly longer life. Additionally, the rigidity provided by the reinforcing flanges 58 and 59 enables the barbed tape 40 to be formed from a material of smaller thickness "c." More particularly, the prior art barbed tape described above and illustrated in FIGS. 1–3 had encountered problems of barb bending with thicknesses of 0.025 inches. The barbed tape 40 illustrated in FIGS. 4–7, on the other hand, provides superior resistance to bends at a thickness "c" of approximately 0.015–0.018 inches. This thinner material can result in a raw material cost saving of more than 20% and will yield efficiencies in storage and shipment. Furthermore, the thinner material at the points of barbs 54–57 will yield a sharper and thus more effective point.

Figure 8:
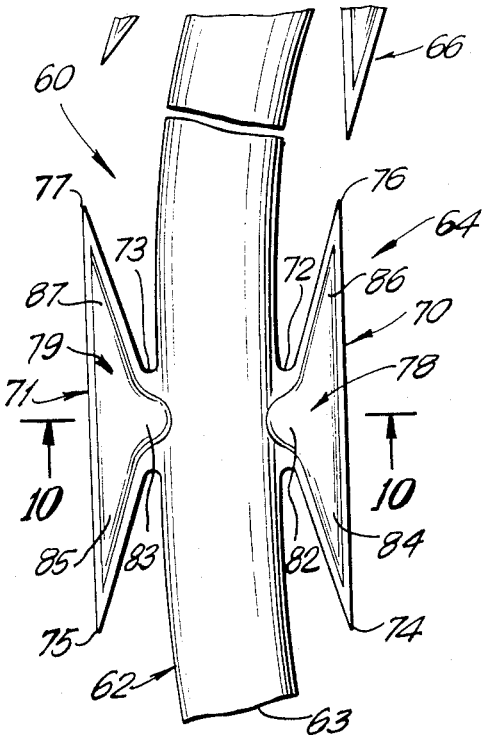
FIG. 8 is a top plan view of a section of an alternate barbed tape formed in accordance with the subject invention.
Figure 9:
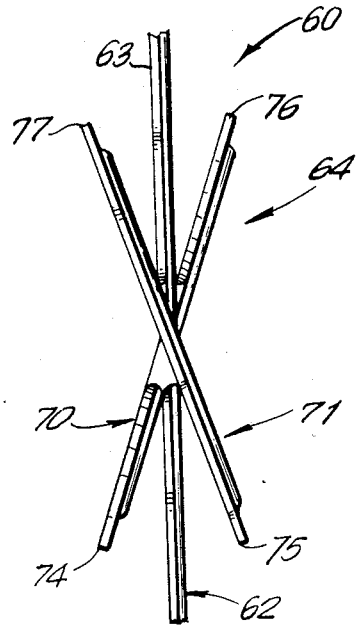
FIG. 9 is a side elevational view of the barbed tape shown in FIG. 8.
Figure 10:
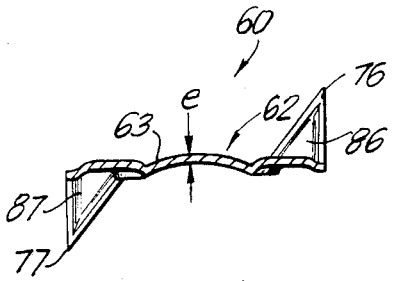
FIG. 10 is a cross-sectional view taken along line 10—10 in FIG. 8.

An alternate embodiment of the reinforced helical barbed tape is illustrated in FIGS. 8–10 and is indicated generally by the numeral 60. The barbed tape 60 is of unitary construction and is provided with a central supporting portion 62 having a longitudinally extending arcuate cavity 63 formed therein. The barbed tape 60 includes a plurality of barb clusters 64, 66 at spaced apart locations along the central supporting portion 62. The barb cluster 64 comprises first and second pairs of barbs 70 and 71 which extend from opposite sides of the central supporting portion 62 and are connected thereto by roots 72 and 73 respectively. The first pair of barbs 70 comprises oppositely directed barbs 74 and 76 while the second pair of barbs 71 comprises oppositely directed barbs 75 and 77. As shown in FIG. 9, the first pair of barbs 70 defines a generally planar structure which is angularly offset relative to the central supporting portion 62. Similarly, the second pair of barbs 71 defines a generally planar structure angularly offset in an opposite direction to the central supporting portion 62.

The first pair of barbs 70 is characterized by a reinforcing embossment 78 which includes a first portion 82 extending into the area of root 72 and which includes additional portions 84 and 86 extending into the areas defining the barbs 74 and 76 respectively. Similarly, the second pair of barbs 71 includes a reinforcing embossment 79 which comprises a portion 83 extending into the area of root 73 and portions 85 and 87 extending into the areas of the barbs 75 and 77. The reinforcing embossments 78 and 79 are stamp formed to extend angularly out of the plane of the first and second pairs of barbs 70 and 71 by a distance approximately equal to the thickness "e" of the barbed tape 60. Preferably, this stamp forming is carried out as part of a sequential process including a prior or simultaneous step of blanking the barbs from a steel tape and a subsequent or simultaneous step of angularly offsetting the barbs relative to the plane of the central portion of the tape. The reinforcing embossments 78 and 79 will prevent both the bending of the individual barbs 74–77 and will further prevent the bending of the respective pairs of barbs 70 and 71 through the respective roots 72 and 73.

Figure 11:
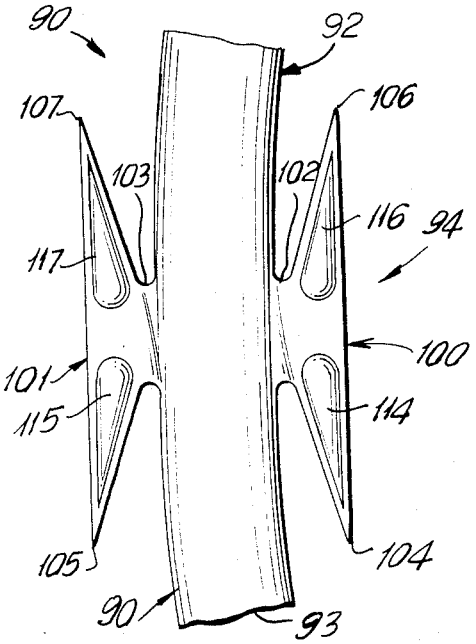
FIG. 11 is a top plan view of a third embodiment of the barbed tape of the subject invention.

A third embodiment of the helical barbed tape having reinforced barbs is illustrated in FIG. 11 and is identified generally by the numeral 90. In this embodiment, as in the previous embodiments, the helical barbed tape 90 is provided with a central supporting portion 92 having a longitudinally extending arcuate cavity 93. The barb cluster 94 includes first and second pairs of barbs 100 and 101 respectively which are connected to opposite sides of the central supporting portion 90 by roots 102 and 103 respectively. The first pair of barbs 100 comprises barbs 104 and 106 which lie generally in a common plane and extend in opposite directions. Similarly, the second pair of barbs 101 comprises barbs 105 and 107 which also lie in a common plane and which extend in opposite directions. As with the previously described embodiments, the first and second pairs of barbs 100 and 101 are angularly offset with respect to one another and with respect to the plane of the central supporting portion 90. The barbs 104–107 are provided with reinforcing embossments 114–117 as shown in FIG. 11. Each reinforcing embossment 114–117 is of generally teardrop configuration and is disposed such that the pointed end of each teardrop shaped embossment 114–117 is aligned in generally the same direction as the point of the associated barb 104–107. In this embodiment, the rounded ends of the respective reinforcing embossments 114 and 116 are spaced from one another and do not extend into the root 103. Similarly, the rounded ends of the reinforcing embossments 115 and 117 are spaced from one another and do not extend into the area of root 103. For the reasons explained above, the reinforcing embossments 114–117 will substantially prevent the bending of the associated barbs 104–107, thereby enhancing the effectiveness of the helical barbed tape 90 and enabling the helical barbed tape 90 to be formed from a thinner material than would otherwise have been required.

Figure 12:
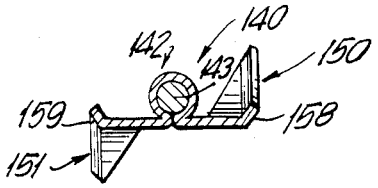
FIG. 12 is a cross-sectional view of a fourth embodiment.

A fourth embodiment of the subject barbed tape is illustrated in FIG. 12 and is indicated generally by the numeral 140. The barbed tape 140 includes pairs of barbs 150 and 151 similar to the pairs of barbs 50 and 51 illustrated in FIGS. 4–7. More particularly, the pairs of barbs 150 and 151 are provided with reinforcing flanges 158 and 159. However, the central portion 142 of barbed tape 140 is wrapped around a helically extending support wire 143. Thus, the helical configuration of the barbed tape 140 will be substantially assured despite the use of a thinner material.

Figure 13:
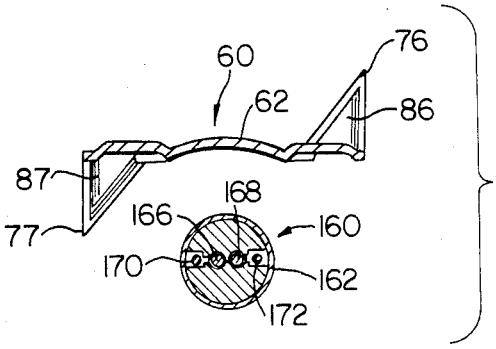
FIG. 13 is exploded, cross-sectional view of the components of the composite reinforced barbed tape with a vibration-sensitive electrical cable.
Figure 14:
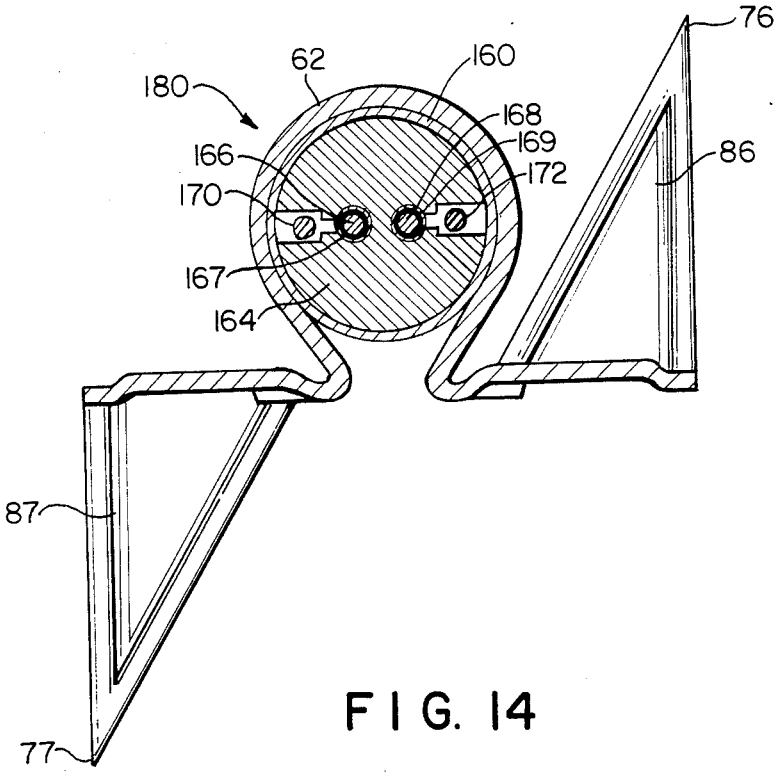
FIG. 14 is a cross-sectional view of the composite, reinforced barbed tape with a vibration-sensitive electrical cable.
Figure 15:
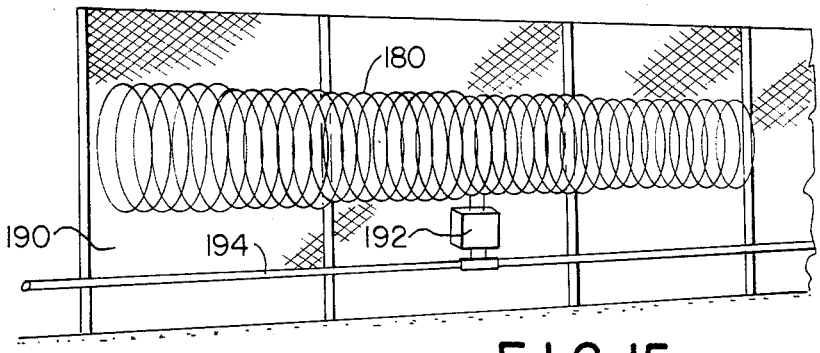
FIG. 15 is a schematic view of an intrusion detection system including the composite reinforced barbed tape of the subject invention.

Turning to FIGS. 13–15, a further embodiment of the subject barbed tape is a composite reinforced barbed tape 180 including electrical sensor means for use in an intrusion detection system. The composite barbed tape 180 is illustrated in cross-section in FIG. 14, while the components of the composite barbed tape 180 are shown in exploded view in FIG. 13. One component of the composite barbed tape 180 is a reinforced barbed tape 60 of the type illustrated in FIGS. 8–10 and which is of unitary construction and is provided with a central supporting portion 62. A plurality of barbed clusters are provided at spaced apart locations along the central supporting portion 62 including barbs 76 and 77 which include the embossed portions 86 and 87. The other component of the composite barbed tape 180 is a vibration-sensitive electrical coaxial cable 160 which may be of the type offered for sale under the trademark "GUARDWIRE" by Del Norte Security Systems, Inc. of Euless, Tex. Coaxial cable 160 basically comprises a continuous length of an outer insulating sheath 162, a flexible magnetic core 164 made of a material such as magnetic silicon rubber, two parallel inductor wires 170 and 172, which are free to move about inside the flexible magnetic core 164, and two return conductors 166 and 168 which are fixed within insulating sheaths 167 and 169, respectively. The arrangement of the four wires 166–172 provides a means so as to cancel out any possible stray electromagnetic interference from the atmosphere. In operation, the slightest movement, and the entire cable 160 becomes, in effect, a linear induction generator. The greater the movement, the greater the current generated.

In the manufacture of the composite reinforced barbed tape 180, the reinforced tape 60 is manufactured, after which the central supporting portion 62 of the tape is roll formed about the coaxial cable 160, thereby resulting in the composite structure as illustrated in FIG. 14. Accordingly, the coaxial cable 160 is disposed in supporting engagement with the central supporting portion 62 of the helical barbed tape along substantially the entire length of the barbed tape.

Referring to FIG. 15, the composite barbed tape 180 may be employed in an intrusion detection system wherein the composite barbed tape 180 is fixedly secured to a fence 190 by suitable attaching means. At spaced locations along the length of the composite barbed tape 180 connections are made to the coaxial vibration-sensitive cable 160 by suitable connectors in order to electrically connect the coaxial cable 160 to a zone processor 192 which is connected by a conduit 194 to a conventional control center, in a manner generally similar to the system disclosed in U.S. Pat. No. 3,763,482.

The subject composite barbed tape 180 is capable of detecting mechanical disturbances induced on the barbed tape 180 or on the supporting fence structure 190. The mechanical disturbances brought about by an intruder climbing, cutting, or crushing, etc. the composite barbed tape 180 or its supporting fence structure 190 causes an electrical signal to be generated between the return conductors 166, 168 and the inductor wires 170, 172 of the coaxial sensor cable 160. The electrical signal is input to the electronic processor 192 which analyzes the signal and makes a determination if the signal level is active enough to declare an alarm condition or to ignore the disturbance. Once the zone processor 192 declares an alarm signal, a signal may be sent to a monitoring control center which can be connected to a variety of conventional monitoring systems, and an indication of the alarm zone or sector is displayed on a monitor, map display, or some other control device. Because of the fact that the electronics of the composite barbed tape 180 is continuously measuring mechanical disturbances, the electrical signals can be converted to an audio signal enabling each zone or sector signals to be amplified and processed electronically to produce the actual disturbance at an audio listen in monitor connected to the zone processor 192.

Accordingly, there is provided a composite, helical barbed tape having barbs with improved rigidity, and having an electrical, vibration-sensitive cable extending along the length thereof, with the barbed tape being disposed about said electrical cable, and with the composite structure being capable of use in an intrusion detection system. Furthermore, the new and improved barbed tape illustrated in FIGS. 13–15 provides both a highly effective personal barrier or entanglement and a detection system, within a single structure. As a result there is attendant savings in labor costs in installation of a single system when using the subject invention, as compared to the additional labor costs required to install conventional sensors in addition to the cost of installing barbed tape.

Figure 16:
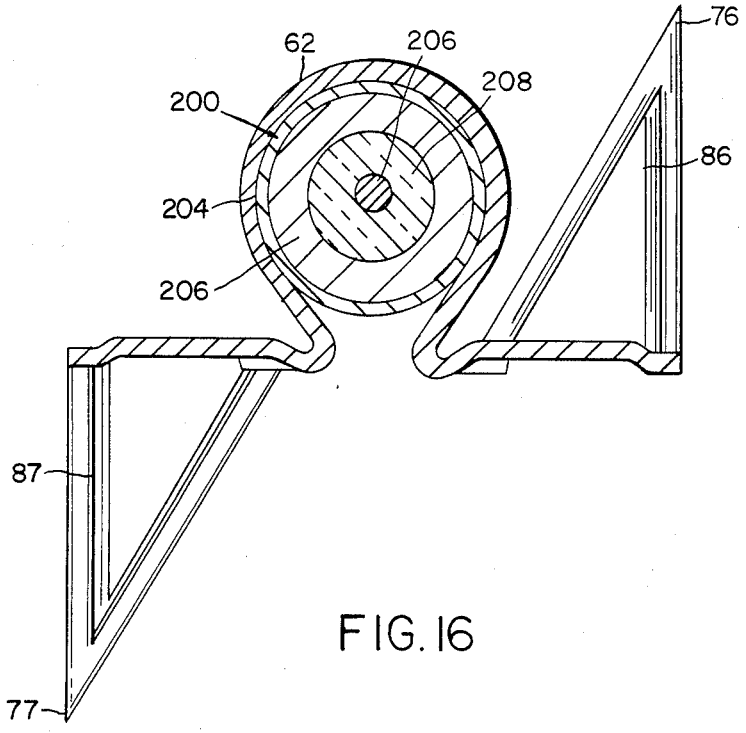
FIG. 16 is a cross-sectional view of the composite, reinforced barbed tape with a vibration-sensitive electret coaxial cable.

FIG. 16 shows an alternate sensor wire disposed in supporting engagement with the arcuate central supporting portion of the helical barbed tape along substantially the entire length of the barbed tape. In particular, FIG. 16 shows the barbed tape 60 with an electrical sensor wire defining a vibration-sensitive electret coaxial cable as shown in the above referenced U.S. Pat. No. 3,763,482. The electret coaxial cable is identified generally by the numeral 200, and comprises an outer conductor 202 covered by an insulating sheath 204. The electrical sensor wire further comprises an inner conductor 206 and a dielectric filler 208 in the space between the inner and outer conductors 206 and 202 respectively. The electrical coaxial cable shown in FIG. 16 operates substantially as described in the above referenced U.S. Pat. No. 3,763,482. The cable shown in FIG. 16 can be incorporated into the environment depicted in FIG. 15 above.

In summary, a helical barbed tape is provided comprising an elongated helically configured central supporting portion and a plurality of barb clusters at spaced locations along the central supporting portion. Each barb cluster includes a pair of barbs connected to opposite sides of the central supporting portion by a root. Each pair of barbs includes first and second barbs which lie generally in a common plane and which extend in opposite directions from one another generally parallel to the direction of the central supporting portion. However, each pair of barbs is angularly offset with respect to the other pair of barbs and with respect to the plane defined by the central supporting portion. The barbs are provided with reinforcements which substantially prevent the respective barbs from being bent during storage, shipment, installation or use. In one embodiment, the reinforcements are defined by reinforcing flanges extending continuously along the sides of the respective pairs of barbs most distant from the central supporting portion of the helical barbed tape. Each reinforcing flange preferably extends angularly from the remainder of the associated barb. In another embodiment, the reinforcement is provided by a reinforcing embossment on each pair of barbs and extending continuously between the two barbs in each pair and into the root connecting the pair of barbs to the central supporting portion. In still another embodiment, the reinforcement is provided by separate reinforcing embossments provided on each of the barbs.

While the invention has been described relative to a preferred embodiment, it is apparent that various changes can be made thereto without departing from the scope of the invention as defined by the appended claims.

What is claimed is:

1. A reinforced barbed tape including electrical sensor comprising:

a helical barbed tape formed from a unitary strip of metallic material and having a continuous elongated central supporting portion of arcuate cross-section, said continuous elongated central supporting portion being of generally helical configuration with the plane of the central supporting portion being aligned generally perpendicular to the axis of the helix, said helical barbed tape further including a plurality of barb clusters disposed at spaced apart locations along said arcuate central supporting portion, each said barb cluster comprising first and second generally planar pairs of barbs disposed on opposite sides of said central supporting portion and connected thereto, each said barb having an embossed reinforcement defining a portion of said barb extending out of the plane of said pair, the embossed reinforcement in each said barb including a pointed end aligned with the point of said barb, with the embossed reinforcement of the barbs in each said pair of barbs extending continuously between said barbs to define a single embossed reinforcement for each said pair of barbs, and wherein each said barb cluster comprises first and second roots extending respectively from opposite sides of said central supporting portion and connecting said first and second pairs of barbs to said central supporting portion, and wherein the single embossed reinforcement for each said pair of barbs extends into the associated root connecting said pair of barbs to said central supporting portion; and an electrical sensor wire disposed in supporting engagement with the arcuate central supporting portion of said helical barbed tape along substantially the entire length of the barbed tape.

2. A reinforced barbed tape as in claim 1 wherein the embossed reinforcement extends from the plane of said barb a distance approximately equal to the thickness of the helical barbed tape.

3. A reinforced barbed tape as in claim 1 wherein the electrical sensor wire comprises a vibration-sensitive electret coaxial cable.

4. A reinforced barbed tape as in claim 1 wherein said electrical sensor wire comprises a vibration-sensitive geophone transducer cable.

5. A reinforced barbed tape as in claim 1 wherein the arcuate central supporting portion is generally annular in cross-section, with the electrical sensor wire being disposed within said arcuate central supporting portion.

6. A reinforced barbed tape as in claim 5 wherein said arcuate central supporting portion is roll formed about said electrical sensor wire.

7. A reinforced barbed tape including electrical sensor comprising:

a helical barbed tape formed from a unitary strip of metallic material having a thickness of between approximately 0.015 inches and 0.030 inches, said helical barbed tape comprising a continuous elongated central supporting portion of arcuate cross-section, said central supporting portion being of generally helical configuration with the plane of the central supporting portion being aligned generally perpendicular to the axis of the helix, said helical barbed tape further including a plurality of barb clusters disposed as spaced apart locations along said central supporting portion, each said barb cluster comprising first and second generally planar pairs of barbs disposed on opposite sides of central supporting portion and connected thereto, each said barb comprising an embossed reinforcement defining a portion of said barb extending out of the plane of said pair, each said reinforcement defines an embossment formed in each said barb which substantially prevents the associated barb from being bent out of the plane of the associated pair of barbs, the embossment in each said barb being of generally teardrop configuration and including a pointed end, said pointed end of said embossment being aligned with the point of said barb, and wherein each said barb cluster comprises first and second roots extending respectively from opposite sides of said central supporting portion and connecting said first and second pairs of barbs to said central supporting portion and wherein the single reinforcing embossment of each said barb extends into the associated root connecting said pair of barbs to said central supporting portion; and an electrical sensor wire disposed in supporting engagement with the arcuate central supporting portion of said helical barbed tape along substantially the entire length of the barbed tape.

8. A reinforced barbed tape as in claim 7 wherein the reinforcing embossments of the barbs in each said pair of barbs extend continuously between said barbs to define a single embossment for each said pair of barbs.

9. A reinforced barbed tape as in claim 7 wherein the embossment extends from the plane of said barb a distance approximately equal to the thickness of the helical barbed tape.

10. A reinforced barbed tape as in claim 7 wherein the electrical sensor wire comprises a vibration-sensitive electret coaxial cable.

11. A reinforced barbed tape as in claim 7 wherein the electrical sensor wire comprises a vibration-sensitive geophone transducer cable.

12. A reinforced barbed tape as in claim 7 wherein the arcuate central supporting portion is generally annular in cross-section, with the electrical sensor wire being disposed within said arcuate central supporting portion.

13. A reinforced barbed tape as in claim 12 wherein said arcuate central supporting portion is roll formed about said electrical wire.

* * * * *